US005383237A

United States Patent [19]

Baker

[11] Patent Number: 5,383,237

[45] Date of Patent: Jan. 24, 1995

[54] TOILET SEAT DEODORIZER APPARATUS

[76] Inventor: David B. Baker, Box 6, Newton Falls, N.Y. 13666

[21] Appl. No.: 172,921

[22] Filed: Dec. 27, 1993

[51] Int. Cl.[6] ..... A42K 13/24

[52] U.S. Cl. ..... 4/237; 4/229; 4/228.1

[58] Field of Search ..... 4/228.1, 234, 237, 242.1, 4/229, 230

[56] References Cited

U.S. PATENT DOCUMENTS

| | | | |
|---|---|---|---|
| 866,400 | 9/1907 | Stevens | 4/229 |
| 2,155,286 | 4/1939 | Winding | 4/234 |
| 2,899,689 | 8/1959 | Pastl | 4/237 |
| 4,301,555 | 11/1981 | Poister . | |
| 4,344,194 | 8/1982 | Pearson . | |
| 5,054,130 | 10/1991 | Wilson . | |
| 5,079,783 | 1/1992 | Haletsky et al. . | |
| 5,086,523 | 2/1992 | De Mott et al. . | |

FOREIGN PATENT DOCUMENTS

| | | | |
|---|---|---|---|
| 0948469 | 2/1964 | United Kingdom | 4/230 |

*Primary Examiner*—Charles E. Phillips

[57] ABSTRACT

A new and improved toilet seat deodorizer apparatus includes a flexible, resilient air pump assembly shaped substantially in the form of a toilet seat, a connector assembly for connecting the air pump assembly to a toilet bowl, and an odor dispenser assembly connected to the air pump assembly. The odor dispenser assembly includes a first screened end in direct communication with air contained within the flexible, resilient air pump assembly and includes a second screened end in direct communication with air which is outside the air pump assembly and the odor dispenser assembly. When a person sits upon the flexible, resilient air pump assembly, a quantity of air is pumped from inside the air pump assembly, through the odor dispenser assembly, to outside the odor dispenser assembly to room air in the room in which the toilet is located. Rigid support members are connected to the flexible, resilient air pump assembly for supporting the air pump assembly a predetermined spaced distance from the toilet bowl. The odor dispenser assembly may be located between the flexible, resilient air pump assembly and the toilet bowl.

3 Claims, 2 Drawing Sheets

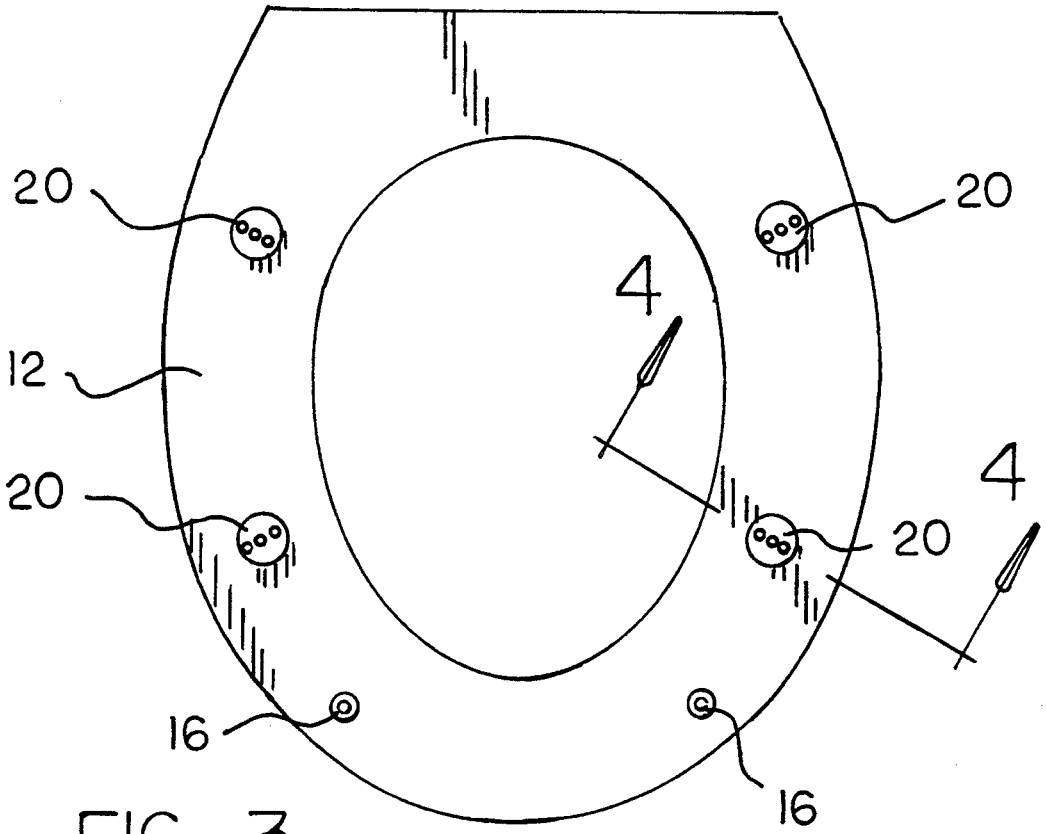
FIG 3
FIG 4
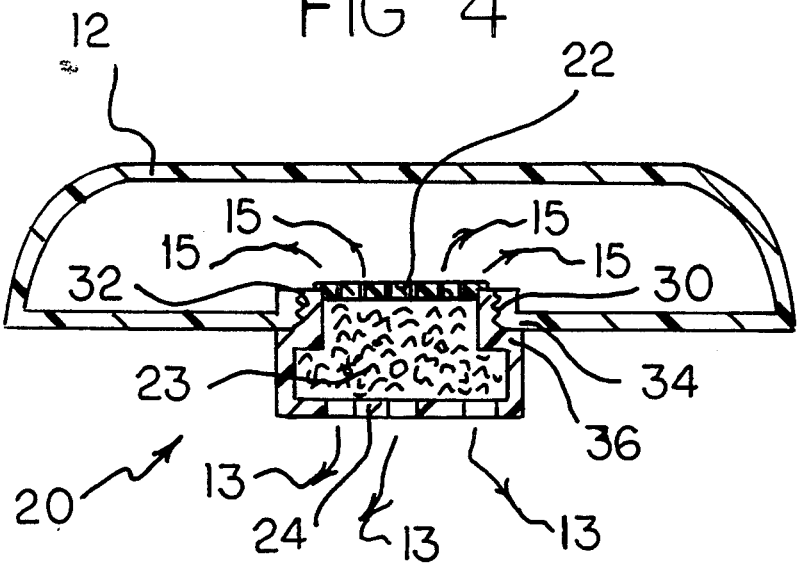

TOILET SEAT DEODORIZER APPARATUS

BACKGROUND OF THE INVENTION

1. Field of the Invention

The present invention relates generally to deodorizer apparatus for bathrooms and, more particularly, to deodorizer devices especially adapted for deodorizing toilets.

2. Description of the Prior Art

Bathrooms are well known to be sources of unpleasant odors, and number of aerosol sprays are especially designed to be used in a bathroom environment. There are times, however, when the use of an aerosol spray is inconvenient. This may be especially true when a person is in a rush. In this respect, it would be desirable if a bathroom deodorizer device were provided which did not require the use of an aerosol spray.

In the bathroom, the toilet is the area that is the source off most of the unpleasant odors. As a result, throughout the years, a number of innovations have been developed relating to deodorizing toilets, and the following U.S. patents are representative of some of those innovations: U.S. Pat. Nos. 4,301,555; 4,344,194; 5,054,130; 5,079,785; and 5,086,523.

More specifically, U.S. Pat. No. 4,301,555 discloses a replaceable filter for deodorizing the air from a toilet bowl. A flexible seal is located between the rim of the toilet bowl and the toilet seat. A quantity of charcoal is placed within the flexible seal. A pump is used to circulate air from the toilet bowl through the charcoal. A disadvantage of this device is the need for an odor-absorbing material such as charcoal. It must be replaced when its odor-absorbing properties are consumed. Moreover, this device requires the use of an air pump to circulate air through the charcoal. The pump requires electrical power, and electrical power is not always readily available, especially in outdoor toilets. Therefore, it would be desirable if a bathroom deodorizer device were provided which does not require an odor-absorbing material such as charcoal. In addition, it would be desirable if a bathroom deodorizer device were provided which does not require a source of electricity for operation.

U.S. Pat. No. 4,344,194 discloses a toilet seat and lid unit with a concealed air deodorizer system which includes an air pump powered by rechargeable batteries. Aside from its need for electric power, albeit by batteries, this device requires the use of a toilet lid. In fact, however, not all toilets are equipped with toilet lids. In this respect, it would be desirable if a bathroom deodorizer device were provided which does not require the presence of a toilet lid.

U.S. Pat. No. 5,054,130 is like the above-mentioned U.S. Pat. No. 4,301,555 in its requirement for an odor-absorbing material and an electrically powered air pump. Moreover, this device requires the presence of a water tank. In fact, however, not all toilets are equipped with a water tank. This is especially so for outdoor toilets. In this respect, it would be desirable if a bathroom deodorizer device were provided which does not require the presence of a water tank.

U.S. Pat. No. 5,079,785 discloses a deodorizing toilet seat that employs a rigid, hollow toilet seat in which are housed a quantity of odor-absorbing material, an electrically-powered air pump for moving air through the odor-absorbing material, and rechargeable batteries for powering the air pump. As mentioned above, the use of odor-absorbing material has the disadvantage of losing its odor-absorbing capacity over time. Moreover, the batteries will drain over time and need to be recharged. Furthermore, many people prefer to employ toilet seats that are soft and flexible, not rigid as required by this device. In this respect, it would be desirable if a bathroom deodorizer device were provided which employed a soft and flexible toilet seat, does not require an odor-absorbing material, and does not require replacement or recharging of an electrical power source.

U.S. Pat. No. 5,086,523 discloses a sanitary attachment that is attached to the bottom surface of a toilet seat. The sanitary attachment provides a handle for the toilet seat so that the toilet seat can be lifted by the handle without touching the toilet seat itself. The attached handle is attached to the toilet seat by a layer of adhesive material. A quantity of deodorizer material is contained in a housing under the adhesive layer. A number of factors work against the handle having a durable attachment to the toilet seat. Leverage between the handle and the adhesive layer tends to pull the adhesive off of the seat. Moreover, the seat has a tendency to get wet, and the moisture may weaken or completely destroy an adhesive bond between the adhesive and the toilet seat. Furthermore, the handle may be difficult to properly clean. In this respect, it would be desirable if a bathroom deodorizer device were provided which does not include an add-on handle.

Still other features would be desirable in a toilet seat deodorizer apparatus. For example, there are toilet seats that are padded and that are flexible and are compressed and emit air when a person sits upon the padded seat. In addition, when the person arises from the toilet seat, the padded seat is resilient and returns to its initial shape. As the padded seat returns to its initial shape, the padded seat sucks in air to replace the air that was squeezed out when the person was sitting on the seat. In this respect, the person sitting upon and rising up from the flexible, resilient toilet seat becomes a motive force for pumping air out of and into the toilet seat. In this respect, it would be desirable if a bathroom deodorizer device were provided which utilizes the motive force of a person sitting upon and rising up from a flexible, resilient toilet seat to move air out of an into the toilet seat.

Materials that bear pleasant odors are often solid materials that are in particulate form. To provide effect pickup of pleasant odors from the particulate material into the room air, an odor pickup chamber is desired. In this respect, it would be desirable if a bathroom deodorizer device were provided for a flexible, resilient toilet seat which includes an odor pickup chamber which houses a quantity of particulate solid odorizing material and permits an air flow from inside the toilet seat, through the odor pickup chamber, to the room air.

As pleasant odors are picked up from the materials that bear the pleasant odors, the pleasant odors gradually dissipate, and eventually, the pleasant-odor-bearing material must be replaced. For convenience, it would be desirable if the odor pickup chamber and the contained pleasant-odor-bearing material could be removed and replaced as a modular unit. This would preclude the necessity of removing the odor pickup chamber, opening the chamber, cleaning the chamber, replacing the spent pleasant-odor-bearing material, closing the chamber, and replacing the chamber back into the toilet seat.

Toilet seats generally have small rigid feet that are attached to the bottom side of the toilet seats and rest on the toilet bowl rim when the toilet seat is lowered to rest upon the rim of the toilet bowl. The rigid feet provide a clearance between the toilet seat and the rim of the toilet bowl. This clearance provides a convenient space in which air flow from the interior of a flexible, resilient toilet seat, through the odor pickup chamber, to the room air can take place. In this respect, it would be desirable if a bathroom deodorizer device were provided with odor pickup chambers that were located in the space between the bottom of the toilet seat and the rim of the toilet bowl.

Thus, while the foregoing body of prior art indicates it to be well known to use deodorizers for toilets, the prior art described above does not teach or suggest a toilet seat deodorizer apparatus which has the following combination of desirable features: (1) does not require the use of an aerosol spray; (2) does not require an odor-absorbing material such as charcoal; (3) does not require a source of electricity for operation; (4) does not require the presence of a toilet seat lid; (5) does not require the presence of a water tank; (6) employs a soft and flexible toilet seat, does not require an odor-absorbing material, and does not require replacement or recharging of an electrical power source; (7) does not include an add-on handle; (8) utilizes the motive force of a person sitting upon and rising up from a flexible, resilient toilet seat to move air out of an into the toilet seat; (9) includes a pleasant-odor-pickup chamber which houses a quantity of pleasant-odor-pleasing particulate solid odorizing material and permits an air flow from inside the toilet seat, through the odor pickup chamber, to the room air; (10) provides an odor pickup chamber and its contained pleasant-odor-bearing material which can be removed and replaced as a modular unit; and (11) provides odor pickup chambers that are located in the space between the bottom of the toilet seat and the rim of the toilet bowl. The foregoing desired characteristics are provided by the unique toilet seat deodorizer apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved toilet seat deodorizer apparatus for a toilet which includes a toilet bowl. The toilet seat deodorizer apparatus includes a flexible, resilient air pump assembly shaped substantially in the form of a toilet seat, a connector assembly for connecting the flexible, resilient air pump assembly to the toilet bowl, and an odor dispenser assembly connected to the flexible, resilient air pump assembly. The odor dispenser assembly includes a first screened end in direct communication with air contained within the flexible, resilient air pump assembly and includes a second screened end in direct communication with air which is outside the flexible, resilient air pump assembly and the odor dispenser assembly, such that when a person sits upon the flexible, resilient air pump assembly, a quantity of air is pumped from inside the flexible, resilient air pump assembly, through the odor dispenser assembly, to outside the odor dispenser assembly, such that odor-bearing air is pumped from inside the odor dispenser assembly to room air in which the toilet is located.

Rigid support members are connected to the flexible, resilient air pump assembly for supporting the flexible, resilient air pump assembly a predetermined spaced distance from the toilet bowl. The odor dispenser assembly may be located between the flexible, resilient air pump assembly and the toilet bowl. The odor dispenser assembly contains a quantity of solid particulate odor-bearing material.

The flexible, resilient air pump assembly includes a threaded aperture, and the odor dispenser assembly includes complementary threads, such that the odor dispenser assembly can be selectively screwed into or out of the flexible, resilient air pump assembly.

The flexible, resilient air pump assembly includes a first sealing surface. The odor dispenser assembly includes a second sealing surface. The second sealing surface is pressed against the first sealing surface when the odor dispenser assembly is screwed into the flexible, resilient air pump assembly, such that an airtight seal is provided between the flexible, resilient air pump assembly and the odor dispenser assembly.

The connector assembly includes a hinge assembly which includes a cylindrical hinge pin member, first connectors for connecting the cylindrical hinge pin member to the toilet bowl, and second connectors for connecting the cylindrical hinge pin member to the flexible, resilient air pump assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved toilet seat deodorizer apparatus which has all of the advantages of the prior art and none of the disadvantages.

It is another object of the present invention to provide a new and improved toilet seat deodorizer apparatus which may be easily and efficiently manufactured and marketed.

It is a further object of the present invention to provide a new and improved toilet seat deodorizer apparatus which is of durable and reliable construction.

An even further object of the present invention is to provide a new and improved toilet seat deodorizer apparatus which is susceptible of a low cost of manufacture with regard to both materials and labor, and which accordingly is then susceptible of low prices of sale to the consuming public, thereby making such toilet seat deodorizer apparatus available to the buying public.

Still yet a further object of the present invention is to provide a new and improved toilet seat deodorizer apparatus which does not require the use of an aerosol spray.

Still another object of the present invention is to provide a new and improved toilet seat deodorizer apparatus that does not require an odor-absorbing material such as charcoal.

Yet another object of the present invention is to provide a new and improved toilet seat deodorizer apparatus which does not require a source of electricity for operation.

Even another object of the present invention is to provide a new and improved toilet seat deodorizer apparatus that does not require the presence of a toilet seat lid.

Still a further object of the present invention is to provide a new and improved toilet seat deodorizer apparatus which does not require the presence of a water tank.

Yet another object of the present invention is to provide a new and improved toilet seat deodorizer apparatus that employs a soft and flexible toilet seat, does not require an odor-absorbing material, and does not require replacement or recharging of an electrical power source.

Still another object of the present invention is to provide a new and improved toilet seat deodorizer apparatus which does not include an add-on handle.

Yet another object of the present invention is to provide a new and improved toilet seat deodorizer apparatus that utilizes the motive force of a person sitting upon and rising up from a flexible, resilient toilet seat to move air out of an into the toilet seat.

Still a further object of the present invention is to provide a new and improved toilet seat deodorizer apparatus that includes a pleasant-odor-pickup chamber which houses a quantity of pleasant-odor-bearing particulate solid odorizing material and permits an air flow from inside the toilet seat, through the odor pickup chamber, to the room air.

Yet another object of the present invention is to provide a new and improved toilet seat deodorizer apparatus which provides an odor pickup chamber and its contained pleasant-odor-bearing material which can be removed and replaced as a modular unit.

Even a further object of the present invention is to provide a new and improved toilet seat deodorizer apparatus that provides odor pickup chambers that are located in the space between the bottom of the toilet seat and the rim of the toilet bowl.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a bottom view of the embodiment of the toilet seat deodorizer apparatus of FIG. 2 taken along line 3—3 thereof.

FIG. 4 is an enlarged cross-sectional view of the embodiment of the invention shown in FIG. 3 taken along line 4—4 thereof.

DESCRIPTION OF THE PREFERRED EMBODIMENT

With reference to the drawings, a new and improved toilet seat deodorizer apparatus embodying the principles and concepts of the present invention will be described.

Figure 1:
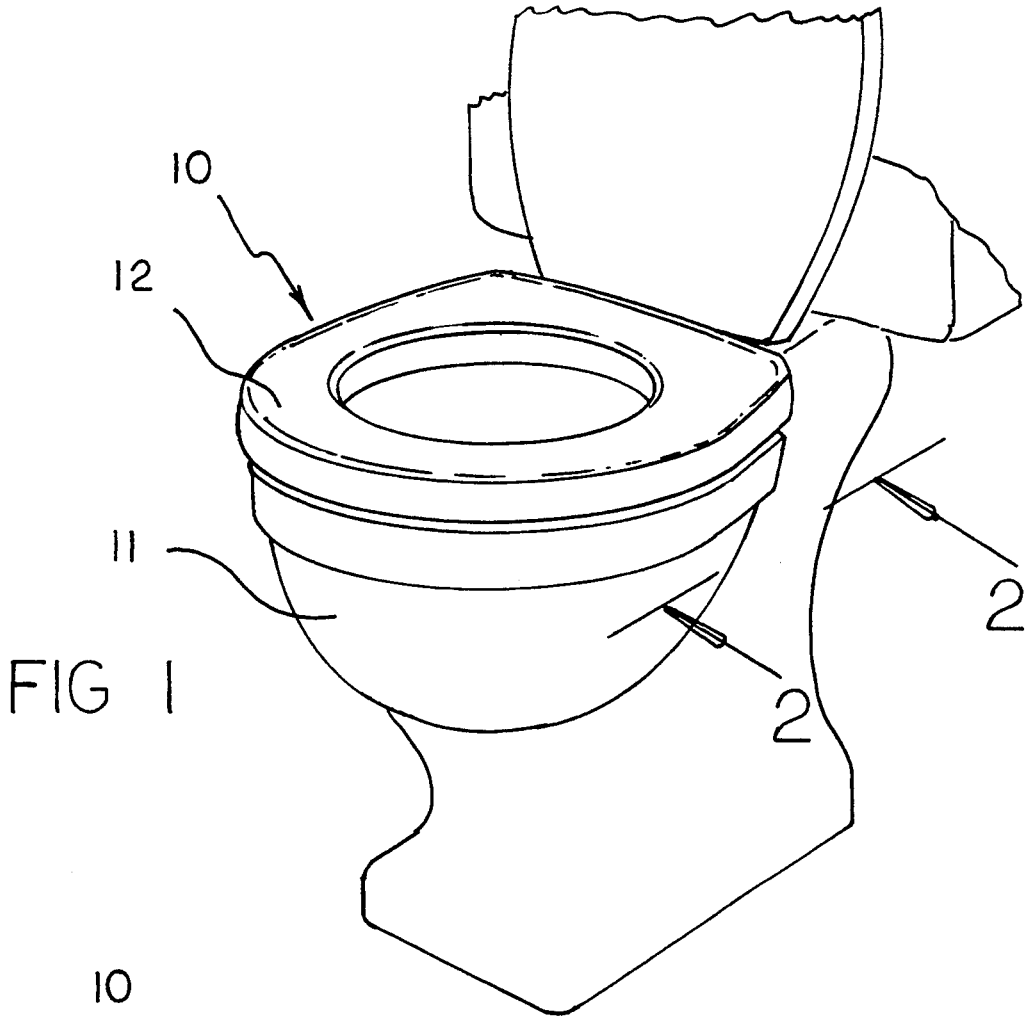
FIG. 1 is a perspective view showing a preferred embodiment of the toilet seat deodorizer apparatus of the invention installed on a toilet bowl.
Figure 2:
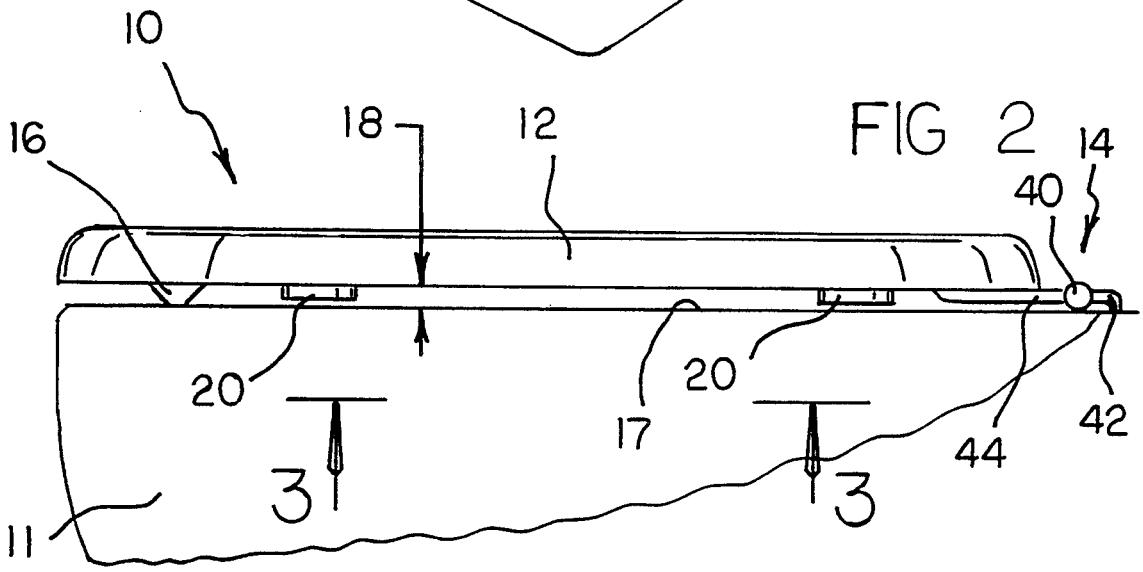
FIG. 2 is an enlarged side view of the embodiment of the toilet seat deodorizer apparatus shown in FIG. 1 taken along line 2—2 thereof, wherein an odor dispenser assembly has its outlet at the bottom side of a flexible, resilient air pump assembly.

Turning to FIGS. 1–4, there is shown an exemplary embodiment of the toilet seat deodorizer apparatus of the invention generally designated by reference numeral 10. In its preferred form, toilet seat deodorizer apparatus 10 includes a flexible, resilient air pump assembly 12 shaped substantially in the form of a toilet seat, a connector assembly 14 for connecting the flexible, resilient air pump assembly 12 to a toilet bowl 11, and an odor dispenser assembly 20 connected to the flexible, resilient air pump assembly 12. The odor dispenser assembly 20 includes a first screened end 22 in direct communication with air contained within the flexible, resilient air pump assembly 12 and includes a second screened end 24 in direct communication with air which is outside the flexible, resilient air pump assembly 12 and the odor dispenser assembly 20, such that when a person sits upon the flexible, resilient air pump assembly 12, a quantity of air represented by downward pointing arrows 13 is pumped from inside the flexible, resilient air pump assembly 12, through the odor dispenser assembly 20, to outside the odor dispenser assembly 20, such that odor-bearing air is pumped from inside the odor dispenser assembly 20 to room air in which the toilet is located. Conversely, when the person arises from the flexible, resilient air pump assembly 12, the flexible, resilient air pump assembly 12 returns to its initial formation shown in FIGS. 1, 2, and 4, and air, represented by upward pointing arrows 15, is drawn from the room, through the odor dispenser assembly 20, into the interior of the flexible, resilient air pump assembly 12.

Rigid support members 16 are connected to the flexible, resilient air pump assembly 12 for supporting the flexible, resilient air pump assembly 12 a predetermined spaced distance 18 from the toilet bowl 11. The odor dispenser assembly 20 may be located between the flexible, resilient air pump assembly 12 and the toilet bowl 11. The odor dispenser assembly 20 contains a quantity of solid particulate odor-bearing material 23.

More specifically, in operation, when air, represented by downward pointing arrows 13, is pumped out of the flexible, resilient air pump assembly 12, the air picks up pleasant odors from the solid particulate odor-bearing material 23 on its way out of the odor dispenser assembly 20 into the room. Thus, every time a person sits on the flexible, resilient air pump assembly 12, a burst of pleasant-odor-bearing air, represented by downward pointing arrows 13, enters the room. The solid particulate odor-bearing material 23 can be pot pori material, among many other possible materials. The flexible, resilient air pump assembly 12 includes a threaded aperture 30, and the odor dispenser assembly 20 includes complementary threads 32, such that the odor dispenser assembly 20 can be selectively screwed into or out of the flexible, resilient air pump assembly 12. The flexible, resilient air pump assembly 12 includes a first sealing surface 34. The odor dispenser assembly 20 includes a second sealing surface 36. The second sealing surface 36 is pressed against the first sealing surface 34 when the odor dispenser assembly 20 is screwed into the flexible, resilient air pump assembly 12, such that an air-tight seal is provided between the flexible, resilient air pump assembly 12 and the odor dispenser assembly 20.

The connector assembly 14 includes a hinge assembly 14 which includes a cylindrical hinge pin member 40, first connectors 42 for connecting the cylindrical hinge pin member 40 to the toilet bowl 11, and second connectors 44 for connecting the cylindrical hinge pin member 40 to the flexible, resilient air pump assembly 12.

The odor dispenser assembly 20 can be made either as a disposable and replaceable modular unit or, alternatively, can be periodically maintained by removing spent odor-bearing material 23, whether solid or liquid, and replacing with active solid particulate odor-bearing material. Aside from their use in toilet seats, the principles of the invention can also be applied to other types of seats such as are used by hunters. In such a case, the odor-beating material can be an animal attractant. In addition, the principles of the invention can be used with seats on snowmobiles and all terrain vehicles.

The components of the toilet seat deodorizer apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved toilet seat deodorizer apparatus that is low in cost, relatively simple in design and operation, and which may advantageously be used without requiring the use of an aerosol spray. With the invention, a toilet seat deodorizer apparatus is provided which does not require an odor-absorbing material such as charcoal. With the invention, a toilet seat deodorizer apparatus is provided which does not require a source of electricity for operation. With the invention, a toilet seat deodorizer apparatus is provided which does not require the presence of a toilet seat lid. With the invention, a toilet seat deodorizer apparatus is provided which does not require the presence of a water tank. With the invention, a toilet seat deodorizer apparatus is provided which employs a soft and flexible toilet seat, does not require an odor-absorbing material, and does not require replacement or recharging of an electrical power source. With the invention, a toilet seat deodorizer apparatus is provided which does not include an add-on handle. With the invention, a toilet seat deodorizer apparatus is provided which utilizes the motive force of a person sitting upon and rising up from a flexible, resilient toilet seat to move air out of an into the toilet seat. With the invention, a toilet seat deodorizer apparatus is provided which includes a pleasant-odor-pickup chamber which houses a quantity of pleasant-odor-bearing particulate solid odorizing material and permits an air flow from inside the toilet seat, through the odor pickup chamber, to the room air. With the invention, a toilet seat deodorizer apparatus is provided which provides an odor pickup chamber and its contained pleasant-odor-bearing material which can be removed and replaced as a modular unit. With the invention, a toilet seat deodorizer apparatus is provided which provides odor pickup chambers that are located in the space between the bottom of the toilet seat and the rim of the toilet bowl.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved toilet seat deodorizer apparatus for a toilet which includes a toilet bowl, comprising:

a flexible, resilient air pump assembly shaped substantially in the form of a toilet seat, a connector assembly for connecting said flexible, resilient air pump assembly to the toilet bowl, a removable and replaceable odor dispenser assembly connected to said flexible, resilient air pump assembly and including a first screened end in direct communication with air contained within said flexible, resilient air pump assembly, and said odor dispenser assembly including a second screened end in direct communication with air outside said flexible, resilient air pump assembly and said odor dispenser assembly, such that when a person sits upon said flexible, resilient air pump assembly, a quantity of air is pumped from inside said flexible, resilient air pump assembly through said odor dispenser assembly to outside said odor dispenser assembly, such that odor-bearing air is pumped from inside said odor dispenser assembly to room air in which the toilet is located, and rigid support members connected to said flexible, resilient air pump assembly for supporting said flexible, resilient air pump assembly a predetermined spaced distance from the toilet bowl, wherein said odor dispenser assembly is located between said flexible, resilient air pump assembly and the toilet bowl, wherein said odor dispenser assembly contains a quantity of solid particulate odor-bearing wherein said flexible, resilient air pump assembly includes a threaded aperture, and said odor dispenser assembly includes complementary threads, such that said odor dispenser assembly can be selectively screwed into or out of said flexible, resilient air pump assembly.

2. The apparatus described in claim 1 wherein:

said flexible, resilient air pump assembly includes a first sealing surface, said odor dispenser assembly includes a second sealing surface, and said second sealing surface is pressed against said first sealing surface when said odor dispenser assembly is screwed into said flexible, resilient air pump assembly, such that an air-tight seal is provided between said flexible, resilient air pump assembly and said odor dispenser assembly.

3. The apparatus described in claim 1 wherein said connector assembly includes a hinge assembly which includes:

a cylindrical hinge pin member, first connectors for connecting said cylindrical hinge pin member to the toilet bowl, and second connectors for connecting the cylindrical hinge pin member to said flexible, resilient air pump assembly.

* * * * *